US012312554B2

(12) United States Patent
Loos

(10) Patent No.: US 12,312,554 B2
(45) Date of Patent: May 27, 2025

(54) ADDITIVE MIXTURE

(71) Applicant: LANXESS DEUTSCHLAND GMBH, Cologne (DE)

(72) Inventor: Annette Loos, Neulussheim (DE)

(73) Assignee: LANXESS Deutschland GmbH, Cologne (DE)

( * ) Notice: Subject to any disclaimer, the term of this patent is extended or adjusted under 35 U.S.C. 154(b) by 0 days.

(21) Appl. No.: 18/579,602

(22) PCT Filed: Jul. 8, 2022

(86) PCT No.: PCT/EP2022/069130
§ 371 (c)(1),
(2) Date: Jan. 16, 2024

(87) PCT Pub. No.: WO2023/011855
PCT Pub. Date: Feb. 9, 2023

(65) Prior Publication Data

US 2024/0336865 A1 Oct. 10, 2024

(30) Foreign Application Priority Data

Aug. 3, 2021 (EP) ..... 21189406
Oct. 20, 2021 (EP) ..... 21203701

(51) Int. Cl.

| | |
|---|---|
| ***C10M 141/08*** | (2006.01) |
| ***C10M 141/10*** | (2006.01) |
| ***C10M 177/00*** | (2006.01) |
| ***C10N 30/00*** | (2006.01) |
| ***C10N 30/10*** | (2006.01) |
| ***C10N 30/12*** | (2006.01) |
| ***C10N 30/18*** | (2006.01) |
| ***C10N 40/00*** | (2006.01) |
| ***C10N 40/12*** | (2006.01) |
| ***C10N 70/00*** | (2006.01) |

(52) U.S. Cl.
CPC ..... *C10M 141/08* (2013.01); *C10M 141/10* (2013.01); *C10M 177/00* (2013.01); *C10M 2209/084* (2013.01); *C10M 2209/103* (2013.01); *C10M 2215/064* (2013.01); *C10M 2215/065* (2013.01); *C10M 2215/223* (2013.01); *C10M 2215/28* (2013.01); *C10M 2219/106* (2013.01); *C10M 2223/047* (2013.01); *C10N 2030/10* (2013.01); *C10N 2030/12* (2013.01); *C10N 2030/18* (2013.01); *C10N 2030/24* (2020.05); *C10N 2040/12* (2013.01); *C10N 2040/135* (2020.05); *C10N 2070/02* (2020.05)

(58) Field of Classification Search
CPC ..... C10M 141/08; C10M 141/10; C10M 177/00; C10M 2209/084; C10M 2209/103; C10M 2215/064; C10M 2215/065; C10M 2215/223; C10M 2215/28; C10M 2219/106; C10M 2223/047; C10N 2030/10; C10N 2030/12; C10N 2030/18; C10N 2030/24; C10N 2040/12; C10N 2040/135; C10N 2070/02
See application file for complete search history.

(56) References Cited

U.S. PATENT DOCUMENTS

| | | | | |
|---|---|---|---|---|
| 5,726,135 | A | 3/1998 | Khorramian | |
| 8,030,259 | B2 | 10/2011 | Aebli et al. | |
| 2008/0058235 | A1 | 3/2008 | Takigawa et al. | |
| 2009/0186789 | A1* | 7/2009 | Nagakari | C10M 141/10 508/438 |
| 2009/0291865 | A1* | 11/2009 | Brennan | C10M 167/00 508/110 |
| 2010/0009875 | A1 | 1/2010 | Dong | |
| 2016/0068781 | A1 | 3/2016 | Yao et al. | |
| 2018/0282655 | A1 | 10/2018 | Shinoda et al. | |
| 2019/0292480 | A1 | 9/2019 | Hoey et al. | |
| 2019/0382682 | A1 | 12/2019 | Kobayashi et al. | |
| 2020/0299604 | A1 | 9/2020 | Hoey et al. | |
| 2020/0362264 | A1* | 11/2020 | Prasad | C10M 133/44 |
| 2022/0356413 | A1 | 11/2022 | Hoey et al. | |

FOREIGN PATENT DOCUMENTS

| | | | | |
|---|---|---|---|---|
| CN | 109135894 | A | 1/2019 | |
| EP | 2055763 | A1 * | 5/2009 | C10M 133/00 |
| JP | 2015189887 | A2 | 11/2015 | |

OTHER PUBLICATIONS

International Search Report from corresponding International Application No. PCT/EP2022/069130, dated Oct. 7, 2022, two pages.
Database WPI Week 201917 2019 Thomson Scientific, London, GB; AN 2019-054679 XP002805218.

* cited by examiner

*Primary Examiner* — James C Goloboy
(74) *Attorney, Agent, or Firm* — Nicanor A. Kohncke; Christopher L. McDavid; Ewa M. Wozniak

(57) ABSTRACT

The present invention relates to new additive mixtures, processes for the production thereof and the use thereof for turbine oils.

11 Claims, No Drawings

ADDITIVE MIXTURE

The present invention relates to new additive mixtures, processes for the production thereof and the use thereof for turbine oils.

PRIOR ART

Turbines, such as steam turbines, gas turbines and water turbines, are generally used to convert kinetic energy into electricity. Effective turbine oils as lubricants are essential for undisrupted operation. The ability to provide reliable lubrication at high operating temperatures over a relatively long period of time is crucial in this case.

A suitable turbine oil for general applications has a series of desirable properties so as to take into account different operating conditions for multiple types of modern industrial turbines. These properties include, for example, a high viscosity index (VI), high oxidation stability (and, associated therewith, long lifetime), low coating/sludge formation, good water separation ability, improved rust and/or corrosion resistance and improved air release and foaming properties.

EP-A 1730101 discloses, for example, additives for turbine oils that contain, as antioxidants, nonyl-/dinonyl- or styrene-substituted N-α-naphthyl-N-phenylamines and nonyl-/dinonyl- or styrene-substituted diphenylamines.

In particular, octyl-substituted N-α-naphthyl-N-phenylamines are increasingly being used, on their own or in combination with various additives, such as U.S. Pat. No. 5,726,135, these having the disadvantage that they are poorly soluble in a mixture with other additives and a relatively large amount of a solubilizer is needed in order to obtain a liquid additive mixture.

WO 2019/183187, EP-A 3712235 and EP-A 2307535 disclose, for example, turbine oils, the oil of which contains, as further constituents, one or more antioxidants from the group of the N-α-naphthyl-N-phenylamines and diphenylamines and also the sulfur-containing additives. It is known that sulfur-containing compounds make it possible to improve the oxidation stability in lubricants, this being evidenced by results in the Rotating Pressure Vessel Oxidation Test (RPVOT, ASTM D 2272) and in the oxidation corrosion test in accordance with ASTM D 4636. Examples are also found in WO 2019/183187. At the same time, however, many sulfur-containing compounds tend to form sludge, which has an adverse effect on the results of other oxidation tests, such as the dry TOST in accordance with ASTM D 7873.

Object of the Present Invention

It is an object of the present invention to provide an improved additive mixture that can be used as turbine oil in particular in combination with a base oil, this turbine oil both meeting the requirements of the oxidation test in accordance with ASTM D 7873 and being intended to pass the corrosion and oxidation test in accordance with ASTM D 4636.

Achievement of the Object

It has now surprisingly been found that the object can be achieved using an additive mixture comprising one or more $C_{10}$-$C_{14}$ alkyl-substituted N-α-naphthyl-N-phenylamines (APANs), alkyl-substituted diphenylamines (DPAs), at least one sulfur-containing compound from the group of the $C_8$-$C_{12}$ alkyl-substituted 2,5-dimercapto-1,3,4-thiadiazoles, and also a benzotriazole derivative.

Subject Matter of the Invention

The present invention provides an additive mixture comprising (a) one or more alkyl-substituted N-α-naphthyl-N-phenylamines (APANs) of formula (I)

(I)

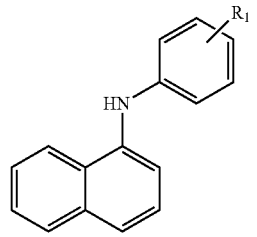

where $R_1$=$C_{10}$-$C_{14}$ alkyl, preferably $C_{10}$-$C_{12}$ alkyl, (b) one or more alkyl-substituted diphenylamines (DPAs) of formula (II)

(II)

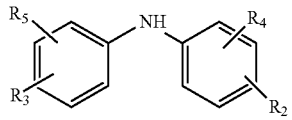

where $R_2$ to $R_5$=independently of one another H, $C_4$-$C_9$ alkyl, preferably $C_4$ alkyl and/or $C_8$-$C_9$ alkyl, with the proviso that at least one of the radicals $R_2$ to $R_5$ is a $C_8$ or $C_9$ alkyl radical, (c) at least one sulfur-containing compound of formula (III)

(III)

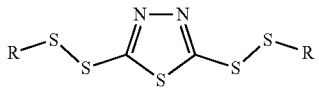

and R=$C_8$-$C_{12}$ alkyl, preferably $C_9H_{19}$ and (d) at least one benzotriazole of formula (IV)

(IV)

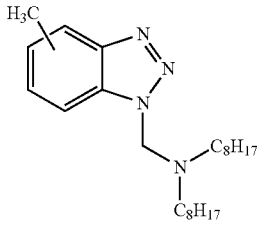

in (e) optionally an oil.

Component (a): The $C_{10}$-$C_{14}$ alkyl-substituted N-α-naphthyl-N-phenylamines (APANs) (a) in the context of the invention are preferably compounds of formula (I) where $R_1$=$C_{10}$-$C_{14}$ alkyl, in which at least 80% by weight of the radicals are $C_{10}$-$C_{12}$ alkyl, particularly preferably $C_{12}$ alkyl. The preferred position of the radical $R_1$ is in the p-position.

In a further preferred embodiment of the invention, component (a) consists to an extent of 80% of monoalkylated $C_{11}$ and $C_{12}$ alkyl radicals.

Component (b): The alkyl-substituted diphenylamines (DPAs) (b) in the context of the invention are preferably a mixture of compounds of formula (II) in which the radicals $R_2$-$R_5$ correspond in total to one, two or three $C_4$ or C alkyl radicals. It is particularly preferred here for the mixture of compounds of formula (II) to consist to an extent of 90% by weight of compounds in which $R_2$ and $R_3$ are a $C_4$ or $C_8$ alkyl radical.

Component (c): The sulfur-containing compounds (c) in the context of the invention are preferably $C_9$ alkyl-substituted 2,5-dimercapto-1,3,4-thiadiazole.

Component (d): The benzotriazole (d) in the context of the invention is preferably N,N-bis(2-ethylhexyl)-methyl-1H-benzotriazole-1-methylamine with methyl in position 4, 5 or 6 and/or N,N-bis(2-ethylhexyl)-methyl-2H-benzotriazole-1-methylamine with methyl in position 4 or 5. The abovementioned benzotriazoles are preferably used as mixtures of 1H-benzotriazole and 2H-benzotriazole in a ratio of 60-70% by weight (1H) to 40-30% by weight (2H).

Component (e): Oil (e) used in the context of the invention can be a mineral oil, a synthetic oil or a mixture thereof. There is no particular restriction with regard to the type of the mineral oil or of the synthetic oil. In general, however, use is made of a mineral oil or a synthetic oil having a kinematic viscosity at 40° C. of 10-25 cSt. Examples of mineral oils include paraffinic mineral oils, intermediate mineral oils and naphthenic mineral oils, and also synthetic oils or acyclic hydrocarbons.

Component (f): In a preferred embodiment of the invention, the additive mixture comprises at least one corrosion inhibitor, particularly preferably a carboxamide (f).

Usable as corrosion inhibitors (f) in the context of the invention are carboxamides, preferably amides of carboxylic acids having 4-50 carbon atoms, such as N-oleylsarcosine or succinamides.

Preference is given to carboxamides (f) based on aspartic acid; particular preference is given here to compounds of the formula

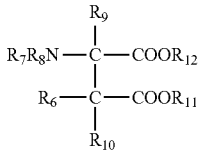

where $R_6$, $R_9$-$R_{12}$=independently of one another H or $C_1$-$C_{30}$ alkyl, $R_7$, $R_8$=independently of one another H, $C_1$-$C_{30}$ alkyl, $C_1$-$C_{30}$ acyl, $C_1$-$C_{30}$ alkoxy; preferably $R_7$ is $C_1$-$C_{30}$ acyl and $R_3$ is $C_1$-$C_{30}$ alkoxy.

Particular preference is given to carboxamides (f) of formula (V)

(V)

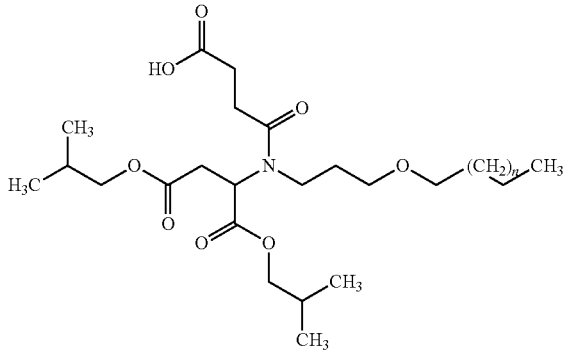

where n=4-10, preferably 5-7.

Component (g): In a further preferred embodiment of the invention, the additive mixture comprises at least one thiophosphate (g).

Usable as thiophosphate (g) in the context of the invention are neutral, covalently bonded thiophosphates and ionic thiophosphates such as amine-neutralized thiophosphoric acid derivatives.

Preference is given to thiophosphates (g) of formula (VI)

(VI)

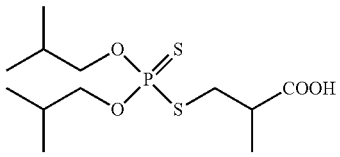

In a further preferred embodiment of the invention, the additive mixture comprises demulsifiers selected from the group of the polyglycols and/or defoamers selected from the group of the polyacrylates.

The polyglycols preferred as demulsifiers are preferably block copolymers of polypropylene glycol and polyethylene glycol.

The polyacrylates preferred as defoamers are preferably homopolymers or copolymers of derivatives of acrylic acid, for example methacrylic acid. The comonomer used is preferably a nonpolar olefin.

Use may also be made, as further constituents of the additive mixture, of dispersants, detergents or flowability-improving additives.

The additive mixture according to the invention preferably comprises the following proportions of components (a) to (e):

- 30-90% by weight, preferably 35-90% by weight, particularly preferably 50-70% by weight, of at least one alkyl-substituted N-α-naphthyl-N-phenylamine (a),
- 0.1-40% by weight, preferably 5-30% by weight, of at least one alkyl-substituted diphenylamine (b),
- 0.5-10% by weight, preferably 2.5-9% by weight, of at least one sulfur-containing compound (c),
- 0.5-10% by weight, preferably 4-9% by weight, of at least one benzotriazole (d) and 0-30% by weight, preferably 15-25% by weight, of at least one oil (e), the sum total of constituents (a) to (e) being 100% by weight.

In a further preferred embodiment of the invention, the additive mixture according to the invention comprises the following proportions of components (a) to (g):

30-85% by weight, preferably 45-60% by weight, of at least one alkyl-substituted N-α-naphthyl-N-phenylamine (a), 0.1-30% by weight, preferably 5-20% by weight, of at least one alkyl-substituted diphenylamine (b), 0.5-5% by weight, preferably 2.5-4% by weight, of at least one sulfur-containing compound (c), 0.5-8% by weight, preferably 4-6% by weight, of at least one benzotriazole (d), 0-30% by weight, preferably 15-25% by weight, of at least one oil (e), 5-15% by weight, preferably 7-10% by weight, of at least one anticorrosion additive, preferably of a carboxamide (f), 0-5% by weight, preferably 1.5-3.5% by weight, of at least one thiophosphate (g), the sum total of constituents (a) to (g) being 100% by weight.

The present invention additionally provides a process for producing the additive mixture according to the invention, whereby components (a) to (d) and optionally (e) to (g) are mixed in any desired order at temperatures of 20 to 100° C., preferably 60-80° C. They are preferably stirred until a homogeneous liquid is present.

Standard mixing units can be used as stirrers.

The present invention additionally provides a turbine oil, comprising the additive mixture according to the invention, preferably to an extent of 0.1-2% by weight, in a base oil.

Usable as base oil are all oils in the 5 main groups according to the classification of the American Petroleum Institute (API). Preference is given to mineral oils of API Group Ill having a viscosity of 32 or 46 cSt at 40° C. (ISO viscosity class 32 or 46).

The present invention additionally provides a process for producing the turbine oil according to the invention, whereby the additive mixture according to the invention having components (a) to (d) and optionally (e) to (g) is stirred into a base oil at temperatures between 2° and 100° C., preferably 40-80° C.

Standard mixing units can be used as stirrers.

The present invention additionally provides the use of the additive mixture according to the invention, preferably in a base oil, as turbine oil.

The process according to the invention is elucidated on the basis of the examples that follow, without being restricted thereto.

EXAMPLES

Production of the Additive Mixture

Compounds (a) to (f) specified in Table 1 in the amounts (% by weight) indicated therein were mixed together at 70° C. until a homogeneous solution was obtained. The mixtures of Examples B to 0 are liquid. The mixture from Example A (comparative example in accordance with EP-A 1730101) is solid and therefore cannot be used in the oil without prior melting.

Production of the Turbine Oil

The previously produced additive mixtures in the amounts (% by weight) indicated in Table 1 were stirred at 70° C. into Yubase, a commercially available mineral base oil of API Group Ill from SK lubricants Co.

TABLE 1

| Example | A (V) [% by weight] | B [% by weight] | C (V) [% by weight] | D (V) [% by weight] |
|---|---|---|---|---|
| (a1) APAN of formula (I) where $R_1$ = $C_{10}$-$C_{12}$ alkyl, proportion of $C_{12}$ = 80% by weight | | 0.27 | 0.27 | 0.27 |
| (a2) APAN of formula (I) where $R_1$ = $C_8$ alkyl | 0.27 | | | |
| (b) diphenylamine DPA of formula (II) (substituted to an extent of 90% by weight by $C_4$, $C_8$) | 0.09 | 0.09 | 0.09 | 0.09 |
| (c) S-compound of formula (III) = 2,5-dimercapto-1,3,4-thiadiazole | 0.015 | 0.015 | 0.039 | — |
| (d) benzotriazole of formula (IV)* | 0.024 | 0.024 | — | 0.06 |
| (f) corrosion inhibitor of formula (V) where n = 5.7 | 0.042 | 0.042 | 0.042 | 0.042 |
| ASTM D 4636 | Solid, not usable | Passed | Failed | Failed |
| Change in acid number (mg KOH/g) | | +0.64 | +0.04 | +6.10 |
| Change in viscosity at 40° C. (cSt) | | +3.30 | +1.0 | +27.7 |
| Change in weight of Al (mg/cm$^2$) | | 0.0 | +0.01 | 0.00 |
| Change in weight of Fe (mg/cm$^2$) | | +0.05 | +0.04 | 0.00 |
| Change in weight of Cu (mg/cm$^2$) | | +0.11 | +0.87 | 0.00 |
| Change in weight of Mg (mg/cm$^2$) | | +0.02 | 0.00 | −3.11 |
| Change in weight of Cd (mg/cm$^2$) | | −0.02 | +0.03 | −17.29 |
| Dry TOST in accordance with ASTM D 7873 | | Passed | | |
| RPVOT - 0 h (min) in accordance with ASTM D 2272 | | 2754 | | |

TABLE 1-continued

| Example | A (V) [% by weight] | B [% by weight] | C (V) [% by weight] | D (V) [% by weight] |
|---|---|---|---|---|
| RPVOT - 1000 h (min) in accordance with ASTM D 2272 | | 800 (29%) | | |
| Sludge after 1000 h (mg/kg) | | 65 | | |

V = comparative example;

RPVOT = Rotating Pressure Vessel Oxidation Test;

*Mixture of N,N-bis(2-ethylhexyl)-methyl-1H-benzotriazole-1-methylamine with methyl in position 4, 5 or 6 and N,N-bis(2-ethylhexyl)-methyl-2H-benzotriazole-1-methylamine with methyl in position 4 or 5 in a ratio of 68% by weight (1H) to 32% by weight (2H).

A test in accordance with ASTM D 4636 is classed as failed for turbine oils if the change in weight of one of the metals (Al, Fe, Cu, Mg or Cd) is greater than 0.25 mg/cm$^2$. A test in accordance with ASTM D 7873 is classed, inter alia, as passed if the RPVOT time after 1000 h is still at least 25% of the original RPVOT time and the sludge after 1000 h is below 100 mg/kg. The following standard tests were performed:

The dry TOST in accordance with ASTM D 7873, as a standard test method for determining the oxidation stability and the formation of insoluble substances of turbine oils at 120° C. without inclusion of water (dry TOST method), and the oxidation test in accordance with ASTM D 4636.

It has now surprisingly been found that the mixture according to the invention of components (a) to (d), see Example B, passes both the oxidation test in accordance with ASTM D 4636 and the dry TOST in accordance with ASTM D 7873 for turbine oils and has a good solubility in oil.

It is evident from the comparative examples that these tests are not fulfilled as soon as one of the components of the mixture according to the invention is absent, or this mixture cannot be stirred into oil without prior work-up if a shorter-chain ($C_8$) APAN is used as component (a).

What is claimed is:

1. An additive mixture comprising (a) one or more alkyl-substituted N-α-naphthyl-N-phenylamines of formula (I)

(I)

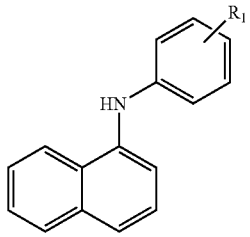

where $R_1$=$C_{10}$-$C_{14}$ alkyl, (b) one or more alkyl-substituted diphenylamines of formula (II)

(II)

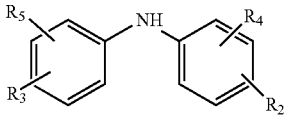

where $R_2$ to $R_5$=independently of one another H, $C_4$-$C_9$ alkyl, with the proviso that at least one of the radicals $R_2$ to $R_5$ is a $C_8$ or $C_9$ alkyl radical, (c) at least one sulfur-containing compound of formula (III)

(III)

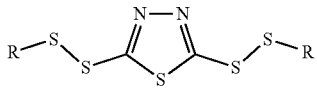

where R=$C_8$-$C_{12}$ alkyl, (d) at least one benzotriazole of formula (IV)

(IV)

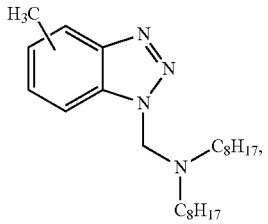

oil (e), and at least one corrosion inhibitor, wherein the at least one corrosion inhibitor is a carboxamide (D) of formula (V)

(V)

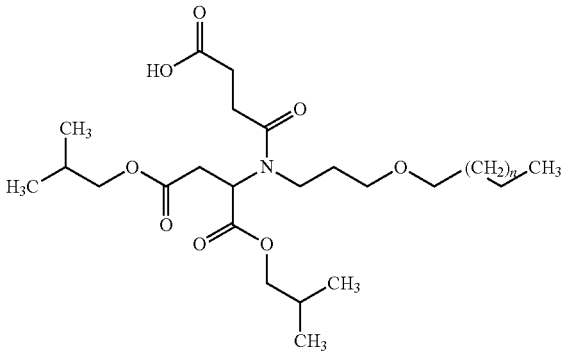

where n=4-10.

2. The additive mixture according to claim 1, comprising at least one thiophosphate (g) of formula (VI)

(VI)

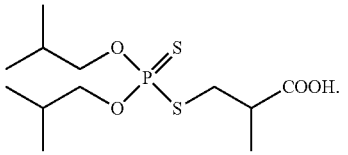

3. The additive mixture according to claim 1, comprising demulsifiers selected from the group of the polyglycols and/or defoamers selected from the group of polyacrylates.

4. The additive mixture according to claim 1, comprising:
35-90% by weight, of at least one alkyl-substituted N-α-naphthyl-N-phenylamine (a),
0.1-40% by weight, of at least one alkyl-substituted diphenylamine (b),
0.5-10% by weight, of at least one sulfur-containing compound (c),
0.5-10% by weight, of at least one benzotriazole (d),
0-30% by weight, of at least one oil (e), 5-15% by weight, of at least one corrosion inhibitor (f),
the sum total of all constituents (a) to (f) being 100% by weight.

5. The additive mixture according to claim 1, comprising:
30-85% by weight, of at least one alkyl-substituted N-α-naphthyl-N-phenylamine (a),
0.1-30% by weight, of at least one alkyl-substituted diphenylamine (b),
0.5-5% by weight, of at least one sulfur-containing compound (c),
0.5-8% by weight, of at least one benzotriazole (d),
0-30% by weight, of at least one oil (e),
5-15% by weight, of at least one corrosion inhibitor (f),
0-5% by weight, of at least one thiophosphate (g),
the sum total of constituents (a) to (g) being 100% by weight.

6. A process for producing an additive mixture according to claim 1 wherein components (a) to (d) and (e) to (g) are mixed at temperatures of 20-100° C.

7. A turbine oil comprising the additive mixture according to claim 1 in at least one base oil.

8. The turbine oil according to claim 7, wherein the proportion of the additive mixture in a base oil is 0.1-2% by weight, based on the turbine oil.

9. A method of incorporating the Use of an additive mixture according to claim 1 in a turbine oil.

10. The additive mixture according to claim 1 comprising:
50-70% by weight, of at least one alkyl-substituted N-α-naphthyl-N-phenylamine (a),
5-30% by weight, of at least one alkyl-substituted diphenylamine (b),
2.5-9% by weight, of at least one sulfur-containing compound (c),
4-9% by weight, of at least one benzotriazole (d),
15-25% by weight, of at least one oil (e), 5-15% by weight, of at least one corrosion inhibitor (f),
the sum total of all constituents (a) to (f) being 100% by weight.

11. The additive mixture according to claim 1, comprising:
45-60% by weight, of at least one alkyl-substituted N-α-naphthyl-N-phenylamine (a),
5-20% by weight, of at least one alkyl-substituted diphenylamine (b),
2.5-4% by weight, of at least one sulfur-containing compound (c),
4-6% by weight, of at least one benzotriazole (d),
15-25% by weight, of at least one oil (e),
7-10% by weight, of at least one corrosion inhibitor (f),
1.5-3.5% by weight, of at least one thiophosphate (g),
the sum total of constituents (a) to (g) being 100% by weight.

* * * * *